United States Patent [19]

Jones

[11] 3,974,495

[45] Aug. 10, 1976

[54] COULOMETRICALLY TIMED INDICATOR LAMP CIRCUITS OPERABLE FROM HIGH VOLTAGES

[75] Inventor: John Paul Jones, Wayne, Pa.

[73] Assignee: Air Products and Chemicals, Inc., Allentown, Pa.

[22] Filed: Feb. 10, 1975

[21] Appl. No.: 548,445

[52] U.S. Cl. ..... 340/309.1; 324/182; 317/230; 307/310

[51] Int. Cl.[2] ..... G08B 1/00; G04F 8/00; G04F 10/00

[58] Field of Search ..... 340/309.1, 309.4; 307/310; 317/230; 324/133, 182

[56] References Cited

UNITED STATES PATENTS 3,192,405 6/1965 Patchell ..... 307/310

3,355,731 11/1967 Jones ..... 340/309.1

*Primary Examiner*—John W. Caldwell
*Assistant Examiner*—William M. Wannisky
*Attorney, Agent, or Firm*—James C. Simmons; Barry Moyerman

[57] ABSTRACT

A three terminal coulometric timer cell is provided having two terminals available to detect continuity of an anode filament that is ruptured after a predetermined time period by plating away upon a cathode cup-like container. Connected across said two terminals is a light emitting diode to visually indicate the end of the time period. Simplified circuit configurations requiring only the cell, two resistors and the light emitting diode are provided with variations permitting AC — DC operation, reliable high voltage operation, low operating power and temperature stable operation.

8 Claims, 6 Drawing Figures

COULOMETRICALLY TIMED INDICATOR LAMP CIRCUITS OPERABLE FROM HIGH VOLTAGES

This invention relates to electronic timers and more particularly it relates to coulometric timing devices which provide a visual display at the end of a predetermined time by lighting a lamp.

BACKGROUND OF THE INVENTION

Coulometric timing cells of the type having an erodable conductive metallic anode filament electrode with two terminal connectors extending therefrom to determine whether the filament is ruptured by electrolytic action are known in the art. Examples of this art together with corresponding operating circuits include U.S. Pat. Nos. 3,355,731 issued Jan. 27, 1965, and 3,769,557 issued Oct. 30, 1973.

Also known in the art are two terminal electrolytic timer cells which have only cathode-anode terminals available separated by an electrolyte solution of a relatively high impedance compared to a short circuited metallic wire conductor. This high impedance is varied slightly by subtle changes occurring as metal is plated from the anode to cathode. Such changes are hard to detect and require sensitive amplifiers working within close tolerances.

It is highly desirable in reliable electronic arts to have binary type operations which positively indicate on-off conditions such as closing and opening of a switch. Under such conditions detection of a change such as occurring at the end of a predetermined plating time represented by change of a short circuit to a high impedance condition would present reliable operating conditions not easily disturbed by transient noise conditions.

In general, applications of these cells and circuits have been in automobiles using low voltage d-c power sources such as 12 volt batteries. However, the timing function is applicable for other purposes such as signifying maintenance time after a predetermined number of elapsed running hours of an electric motor operating at 110V or 220V AC. For such applications the prior art has not provided acceptable inexpensive timer circuits operating from high voltage AC without introduction of transformers and power supply circuits. When used in these environments several special problems are encountered when amplifiers are necessary because of sensitivity to high voltage transient signals present. Thus, immunity to high voltage electrical noise is a desirable feature not generally available in prior art devices.

Also in many such applications there is a requirement for very low cost in order to justify use so that simplified operating circuits without necessitating sensitive amplifiers and noise immunity devices are essential.

Furthermore, in general, reliability is decreased in circuits having greater numbers of parts, because of the increased chances for circuit failure.

A still further problem particularly with high voltage — high impedance circuits is the propensity for failure in the presences of environmental conditions of humidity and dust, or changes in ambient temperature. Also changes in operating voltages tend to cause errors in some types of prior art timing circuits.

It is therefore a general object of this invention to provide improved coulometric timing circuits resolving one or more of the aforesaid deficiencies.

A more specific object of the invention is to provide coulometric timing circuits operable directly from high voltage AC lines without isolation transformers.

Another object of the invention is to provide coulometric timing circuits having fewer parts.

Also, objects of the invention are to provide operation of a coulometric cell with efficient operation at low impedance levels, and under conditions of varying voltage and temperature.

Other objectives, features and advantages of the invention will be found throughout the following specification.

Summary of the Invention

Therefore, in accordance with this invention a light emitting diode is coupled across two switching terminals of a three terminal coulometric timer cell to indicate the presence of an anode filament discontinuity at the end of a predetermined timed period of coulometric deplating changing a switch closure short circuit to a high impedance condition. A current limiting resistor from the voltage supply establishes proper voltage drops across the cell switch terminals both during life and after end-of-life to cause the light emitting diode to visually glow after end of the timed period. One further timing resistor establishes a predetermined coulometric deplating time period to constitute a basic circuit configuration of only four simple electronic components.

The basic four component circuits can be simply varied by addition of a diode rectifier for use with a-c power sources or by addition of a diode regulator for temperature stabilization and increased reliability particularly in the presence of non-regulated voltage sources and electrical noise conditions.

Thus, the invention provides a temperature stabilized AC — DC low powered coulometric timing cell, which produces an on-off type signal by means of a visual indication after expiration of a measured timing period.

BRIEF DESCRIPTION OF THE DRAWINGS

In the accompanying drawings, in which like reference characters are used throughout the various views to designate similar parts.

DESCRIPTION OF THE PREFERRED EMBODIMENT

Figure 1:
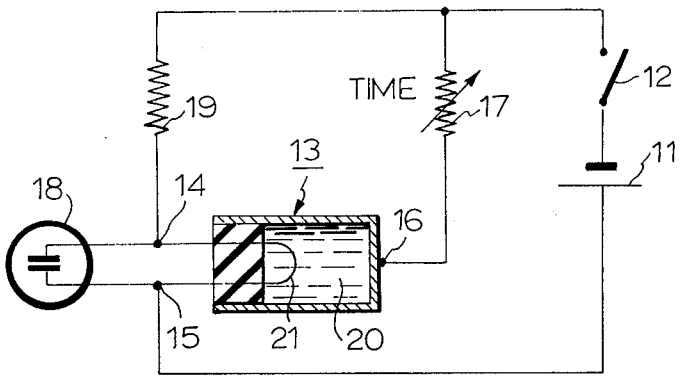
FIG. 1 shows a simplified d-c source timing circuit configuration of the invention.
Figure 2:
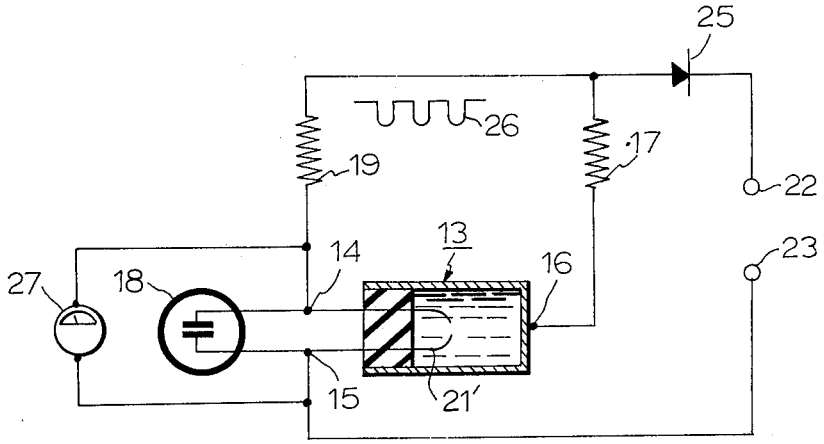
FIG. 2 shows an AC — DC version of the timing circuit afforded by this invention.

In FIG. 1 a d-c operated circuit configuration has battery source 11 coupled to a timer circuit through a control switch 12. The timer circuit has a coulometric cell 13 of the three terminal (14, 15, 16) type wherein an anode filament 21 is connected to external terminals 14 and 15 afforded to permit sensing of discontinuity. Thus, the path between terminals 14 and 15 is short circuited when the anode filament 21 is intact, but presents a finite resistance through the electrolyte solution 20 when ruptured (as shown in FIG. 2) by plating away on the metal cathode can connected to terminal 16. Such coulometric timer cells are available commercially under the type designation T-2 from the Compuline Division of Air Products and chemicals, Inc. at Norristown, Pa.

Control of the coulometric plating current from battery source 11 is in resistor 17 which may be varied in resistance as indicated by the arrow to choose a predetermined time of operation to end-of-life when anode filament 21 is ruptured by plating off on the inside of the metallic cathode shell connected to terminal 16. Typical times may be set from a few hours to many thousands of hours and precise control is easily held over the predetermined life period within ± 5%.

When the anode filament 21 ruptures at end-of-life the essentially zero ohm shunt circuit is removed from the terminals 14, 15 and the internal resistance of the cell 13 becomes high enough to permit the current through light emitting diode 18 to exceed the visual threshold as provided from battery 11 through current limiting resistor 19.

As may be seen in FIG. 2, the terminals 22, 23 may be connected to any desired power source of constant potential such as for example, that at the terminals of a motor or other appliance thereby to indicate running time. The voltage may typically be 110V A.C. The rectifier 25 therefore provides a half wave rectified waveform 26 at the anode filament terminal 14 which serves a dual purpose. Thus a coulometric plating potential is established across the cell to terminal 16 by way of resistor 17 with a d-c component which will cause the anode filament 21 to plate onto the cathode shell and rupture after a predetermined period of operation established by the voltage connected at terminals 22, 23 and the value of resistor 17. Also upon obtaining discontinuity of filament 21, the light emitting diode will be lighted by the pulsating d-c potential through rectifier 25. The rectifier 25 although inexpensive such as commercially available type 4004, may be omitted if the power source at terminals 22 and 23 is DC of the polarity shown in FIG. 1.

As signified by voltmeter 27 the voltage across presently commercially available light emitting diodes remains substantially constant at a typical low voltage of 1.5 volts over a wide range of current flowing through resistor 19, for example 10 to 20 milliamperes. This light emitting diode thereby serves as a voltage limiting device at the broken ends of anode filament 21 so that hydrolysis or gassing is prevented within the capsule after rupture of the anode at the end of the predetermined operating time period.

The current limiting resistor 19 may typically be a two watt resistor for 110 volt AC operation of proper resistance to establish a current above the lighting threshold of the light emitting diode 18, preferably in the order of 10 to 20 milliamperes. Thus, this embodiment can be employed as a universal AC — DC type timer adaptable to various voltages by changing the resistance of resistor 19 and to various predetermined time periods by choosing the resistance of resistor 17.

If the timer circuit is to be operated under conditions where temperatures change significantly, then the timing accuracy could be impaired because of changes in the coulometric plating rate of the cell 13 with changes in temperature. Accordingly in FIG. 3 a silicon diode rectifier 30, such as commercially available type 1N917 is connected between the anode terminal 15 and the negative pole of battery 11′. Note that primed reference characters indicate a change in connection or function of the designated components, and thus battery 11′ is connected in opposite polarity to battery 11. Thus, also the timing resistor 17′ is connected at negative battery terminal 31. This configuration therefore has the resistor 19 for limiting current from battery 11′ connected to one battery terminal from the cell anode terminal 14 and a diode rectifier 30 connected to the other battery terminal from the cell anode terminal 15.

Figure 3:
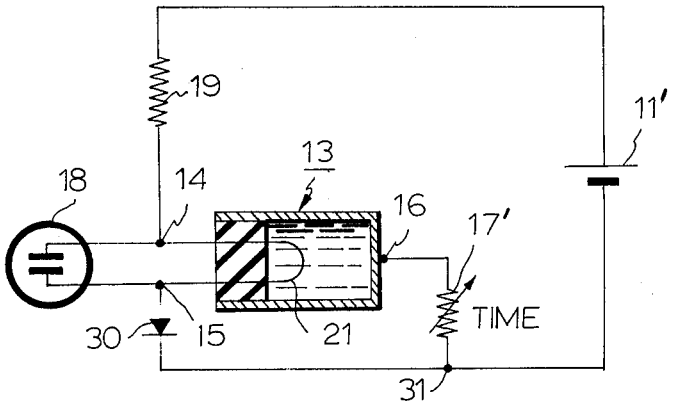
FIG. 3 shows a temperature and voltage stabilized circuit embodiment afforded by the invention.

In operation the circuit of FIG. 3 establishes a forward voltage drop of about ¾ volt across the diode 30. This serves as a lower voltage plating source which permits use of lower value resistors 17′ dissipating less power than the equivalent higher value resistors 17 in the configuration of FIGS. 1 and 2. Typically the resistor 17′ may have a resistance in the order of 50 ohms per expected hour of life. Also such low resistance values are preferred whenever high humidity conditions or dust, etc., can cause a leakage path.

Figure 4:
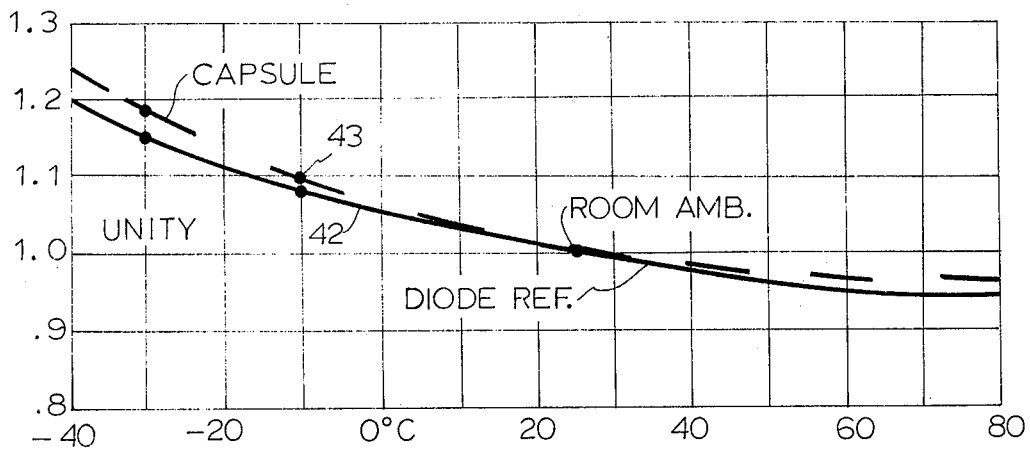
FIG. 4 is a graph illustrating the mode of temperature compensation afforded by the circuit embodiment of FIG. 3.

In addition to these advantages, FIG. 4 illustrates that the temperature characteristics 42 of the diode rectifier 30 almost exactly match those 43 of the cell capsule 13 for a wide range of temperature values indicated on the abcissa. The ordinate shows, on the basis of unity, the relative variation with temperature of both the diode forward voltage drop and the plating time of the capsule 13 on a comparative basis. Thus, in the circuit of FIG. 3 diode rectifier 30 compensates for temperature variations so that more precise timing periods will result in operation under varying temperature conditions.

Consider that as temperature decreases, the cell 13 will take longer to rupture anode filament 21 while at the same time the voltage at diode 30 gets higher to thereby make the cell plate faster. This is the proper polarity of change to compensate for the change in plating time with temperature.

Figure 5:
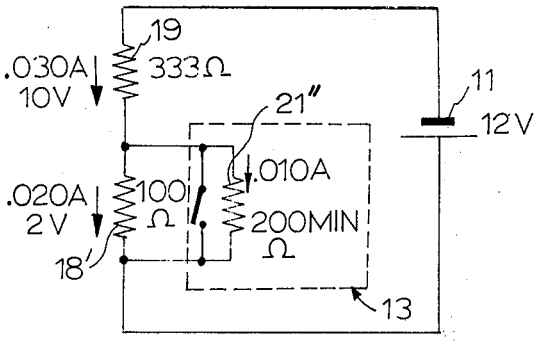
FIG. 5 is an equivalent circuit diagram illustrating typical circuit values for operation of the light emitting diode circuit afforded by this invention.

The equivalent circuit of FIG. 5 shows typical conditions encountered in the circuit portion that causes the light emitting diode to light and give a visual indication after end-of-life when filament 21′ (FIG. 2) is ruptured. The designation 21″ then is that typifying the internal electrolyte resistance within cell 13 between the ruptured ends of filament 21′ as soon as the rupture takes place.

The resistance of the light emitting diode 18 is typified by resistor 18′. Thus, at the operating battery voltage of 12 volts with a current limiting resistor 19 of 333 ohms, the current passed through light emitting diode 18 will approximate 20 milliamperes and thus the light emitting diode 18 will become visibly lighted.

Figure 6:
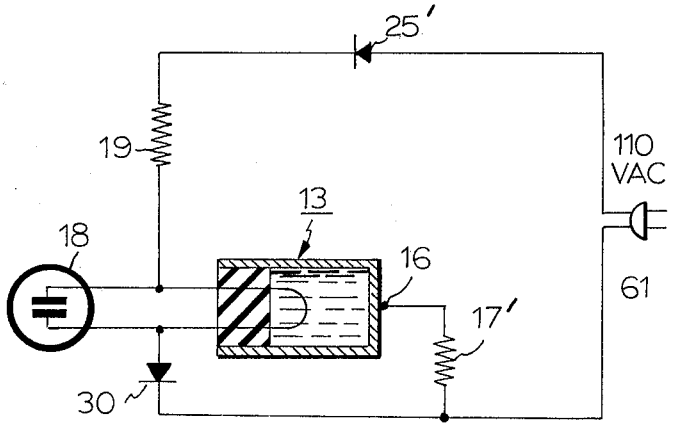
FIG. 6 shows a further circuit embodiment of a low-power-consumption, temperature-stabilized, AC — DC embodiment of the invention providing stability in the presence of voltage changes and electrical noise and using a minimum number of electronic circuit components.

The embodiment of FIG. 6 incorporates both the AC — DC feature by employment of diode rectifier 25′ and the temperature compensation feature introduced by diode rectifier 30. In this embodiment it is noted as a further advantage that no isolation transformer or special noise eliminator circuits are necessary. Resistor 19 would be a high resistance such as 4000 ohms that limits current to about 30 ma, and drops the line voltage to that required for sustaining the forward diode conductance.

It is also noted that by use of the light emitting diode 18 and the switch action of the cell 13, the circuit is unreliably affected in the presence of high voltage transients such as inductive "kicks," as is the case when transistors or amplifiers are necessary.

Furthermore in the circuit of FIG. 3, the forward conductance of diode 30 establishes a constant regulated voltage drop that does not change appreciably with large percentage changes of line voltage so that it acts also as a voltage regulated circuit, so that plating time is not as subject to changes caused by a change of input potential.

Accordingly it may be recognized that this invention has provided improved timing circuits that have various operational advantages while at the same time minimizing the number of elements employed and the cost of both initial parts and operation.

What is claimed is:

1. A coulometric timing device comprising in combination, a coulometric cell having an erodable electrode with two terminal connectors thereto extending from the cell, an electronic coulometric timing circuit connected to cause said erodible electrode to develop a discontinuity between said terminals, means for coupling a two terminal electric source to produce a potential across said discontinuity, a light emitting diode circuit connected across said two terminal connectors to emit visible light only when a discontinuity is encountered in said filament wire and means limiting the current from said source to said terminal connectors and said light emitting diode.

2. A device as defined in claim 1, wherein said means for coupling the source comprises a rectifier connecting said source to said terminal connectors.

3. A device as defined in claim 2, wherein said means limiting the current is connected to one terminal of said electric source and said rectifier is connected to the other terminal of said source.

4. A device as defined in claim 3, wherein said coulometric cell has a metallic outer shell electrode and a current limiting resistor is connected from said shell to that one said electric source terminal to which said rectifier is coupled to thereby control the coulometric current passing through said cell.

5. A device as defined in claim 1, wherein said coulometric cell has a metallic outer shell electrode and a current limiting resistor is connected from said shell to said electric source terminal to thereby control the coulometric current passing through said cell.

6. A device as defined in claim 5, wherein said means limiting the current is connected to one terminal of said source and a rectifier diode is connected to the other terminal of said source.

7. A device as defined in claim 6, wherein said current limiting resistor connected from said shell is connected to that one terminal of said source to which said rectifier diode is connected.

8. A coulometric timing device comprising in combination, a three terminal coulometric cell having a rupturable metallic anode filament disposed between a first two of said terminals and a cathode connected to the third said terminal, a circuit selectively connecting a source of potential to the third of said terminals as a cathode and to one of said first two terminals as an anode to thereby plate away said filament anode on said cathode at a known rate as a function of current, a light emitting diode having two terminals connected to the first two said anode terminals thereby to be shunted by said anode filament until it is ruptured, and a current limiting resistor connected to said source from said light emitting diode to provide current above the lighting threshold to said light emitting diode when said anode filament is ruptured by plating away on said cathode.

* * * * *